US006179016B1

(12) United States Patent
Neacker et al.

(10) Patent No.: US 6,179,016 B1
(45) Date of Patent: Jan. 30, 2001

(54) FILLING MACHINE ASSEMBLY HAVING A MAGNETIC ADJUSTMENT MECHANISM

(75) Inventors: Jens Neacker, Hamburg; Wolfgang Wilke, Hoisdorf, both of (DE)

(73) Assignee: Crown Simplimatic Incorporated, Lynchburg, VA (US)

( * ) Notice: Under 35 U.S.C. 154(b), the term of this patent shall be extended for 0 days.

(21) Appl. No.: 09/453,352

(22) Filed: Dec. 1, 1999

Related U.S. Application Data

(60) Provisional application No. 60/116,463, filed on Jan. 20, 1999.

(30) Foreign Application Priority Data

Dec. 4, 1998 (DE) ..... 198 55 975

(51) Int. Cl.[7] ..... B65B 1/04
(52) U.S. Cl. ..... 141/39; 141/45; 141/290
(58) Field of Search ..... 141/39–45, 47–50, 141/59, 285, 289, 290, 301, 308, DIG. 1

(56) References Cited

U.S. PATENT DOCUMENTS

| | | |
|---|---|---|
| 3,595,280 | 7/1971 | Fissell . |
| 3,633,635 | 1/1972 | Kaiser . |
| 4,589,453 | 5/1986 | Weiss . |
| 4,653,551 | 3/1987 | Sindermann . |
| 4,679,603 | 7/1987 | Rademarcher et al. . |
| 4,938,261 | 7/1990 | Petri et al. . |
| 4,989,650 | 2/1991 | Weiss . |
| 5,000,234 | 3/1991 | Weiss . |
| 5,040,574 | 8/1991 | Petri et al. . |
| 5,065,799 | 11/1991 | Weiss . |
| 5,139,058 | 8/1992 | Yun . |
| 5,295,517 | 3/1994 | Ahlers . |
| 5,313,990 | 5/1994 | Clusserath . |
| 5,329,963 | 7/1994 | Jones et al. . |
| 5,377,726 | 1/1995 | Clusserath . |
| 5,413,153 | 5/1995 | Zwilling et al. . |
| 5,445,194 | 8/1995 | Clusserath . |
| 5,501,253 | 3/1996 | Weiss . |
| 5,727,606 | 3/1998 | Weiss . |

FOREIGN PATENT DOCUMENTS

| | | |
|---|---|---|
| 1023688 | 1/1958 | (DE) . |
| 3446500 | 8/1986 | (DE) . |
| 1963604 | 9/1997 | (DE) . |

*Primary Examiner*—Steven O. Douglas
(74) *Attorney, Agent, or Firm*—Howard & Howard

(57) ABSTRACT

A filling machine assembly (20) for filling a beverage container (24), such as a bottle or can, with a liquid beverage, such as beer or soft drinks. The filling machine (20) includes a support housing (40) having an inner fluid chamber (46) for supplying the liquid to be discharged into the container (24). A valve housing (48) is mounted to the bottom (16) of the support housing (40) for controlling the discharge of the liquid and a control device (52) is disposed adjacent to the top (14) of the support housing (40). A vent tube (54) is actuated upward and downward via the control device (52) and extends into the valve housing (48). The filling machine (20) is characterized by the control device (52) including at least one magnet (66) moveable between a first position and a second position for moving the vent tube (54) a predetermined stroke between a filling position and a non-use position. The subject invention also incorporates the novel feature of having a support tube (60) mounted within the support housing (40) and substantially surrounding the vent tube (54) with the support tube (60) having an upper portion (76) extending above the upper surface (42) outside of the fluid chamber (46).

27 Claims, 6 Drawing Sheets

68
72
52
66
70
74
66
42
56
60
62
64
46
40
54
20
62
60
44
48
58
50
58

52
68
70
66
74
72
66
56
42
64
60
62
54
40
46
20
62
60
48
44
50
58

88
74
86
80
90
90
92
42
46
84
76
72
78
56
52
82
66
20
40
60
62
44
50
48
48
54
58
24

FILLING MACHINE ASSEMBLY HAVING A MAGNETIC ADJUSTMENT MECHANISM

RELATED APPLICATION

This patent application claims priority to and all the benefits of German Patent Application No. 198 55 975.5 filed on Dec. 4, 1998 and entitled "Beverage Filling Assembly with a Gas Return Pipe". This patent application also claims priority to and all the benefits of U.S. Provisional Patent Application Ser. No. 60/116,463 filed on Jan. 20, 1999 and entitled "Filling Machine Assembly having a Magnetic Adjustment Mechanism".

BACKGROUND OF THE INVENTION

1) Technical Field

The subject invention relates to a beverage filling machine having an adjustable vent tube.

2) Description of the Prior Art

Filling mechanisms used for filling containers, such as cans, jars, or bottles, with a beverage, such as beer or soft drinks, are well known in the art. The conventional filling mechanisms feed the containers into a star wheel conveyor which individually positions each container on a rotating turntable below a valve assembly of an individual filling machine. The container moves into sealing engagement with the valve assembly by either moving the container upwardly or by lowering the valve assembly. The filling machines are known in the art as counter pressure filling machines as is discussed below. There may be as many as 120 individual filling machines disposed circumferentially around the turntable. The filling machines typically include a support housing having an inner fluid chamber or ring bowl disposed above the valve assembly. The ring bowl is usually annular and contains the liquid or beverage for filling the containers and has a space above the liquid for a pressurized inert gas such as carbon dioxide or nitrogen. This space above the liquid is known as the headspace. A common storage tank or reservoir feeds each individual ring bowl with the liquid and gas.

In the typical filling operation, the container, which is sealed against the valve assembly, is initially purged with the inert gas from the ring bowl for a predetermined time in order to flush air and other impurities from the container. A vent tube is introduced into the container to accomplish this an other operations. The liquid is filled into the container from the ring bowl while the gas from the container vents through the vent tube into the headspace. The liquid will at least partially rise into the vent tube during the filling of the container. The gas pressure in the container and the ring bowl are equalized when filling begins. This is what is known as counter pressure, which allows the liquid to flow into the container solely under the influence of gravity. After the container is filled to a desired level, the vent tube rises out of the container. Finally, gas is released from the headspace of the container to the atmosphere by an process commonly known as "snifting".

The beverage filling industry continuously strives for machinery and methods which facilitate rapid, economical, efficient, and sterile filling of containers. As discussed above, methods and apparatuses for filling containers with carbonated liquids have evolved into counter pressure filling machines. The prior art devices utilize complicated mechanical or pneumatic mechanisms for adjusting the height of the vent tube during the filling operation.

Examples of such devices are shown in U.S. Pat. No. 3,595,280 to Fissel and U.S. Pat. No. 3,633,635 to Kaiser. These known devices can be expensive and difficult to maintain.

Further, such mechanical or pneumatic devices could significantly jeopardize the sterile environment of the filling machines. In particular, the known prior art devices utilize a number of seals which separate the inner working components of the filling machine, which include the vent tube, with the atmosphere. The pressures exerted against the seals can be significant. Hence, after repeated use, the seals are subject to failure which reduces the operating life of the filling valves and effects the integrity of the entire filling machine.

Accordingly, there is a need for a vent tube adjustment mechanism which is of a relatively simple design and does not jeopardize the sterile environment of the filling machines. The adjustment mechanism preferably eliminates the seals which are subject to the counteracting pressures of the filling machines, thereby reducing the likelihood of a failure.

SUMMARY OF THE INVENTION AND ADVANTAGES

A filling machine assembly for filling a container with a fluid material. The filling machine assembly comprises a support housing having an upper surface and a lower surface defining an inner fluid chamber for supplying the fluid material to be discharged into the container. A valve housing is mounted to the lower surface of the support housing for controlling the discharge of the fluid material. A control device is disposed adjacent the upper surface of the support housing. A vent tube has a first end and a second end with the second end at least partially extending through the valve housing. The assembly is characterized by the control device including at least one magnet moveable between a first position and a second position for moving the vent tube a predetermined stroke between a filling position and a non-use position.

Accordingly, the subject invention discloses a novel means of adjusting a vent tube during a filling operation which has few moving parts thereby promoting the sterile environment of the filling machine. In addition, the control device of the subject invention preferably eliminates the movement of parts throughout a seal which is under pressure.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
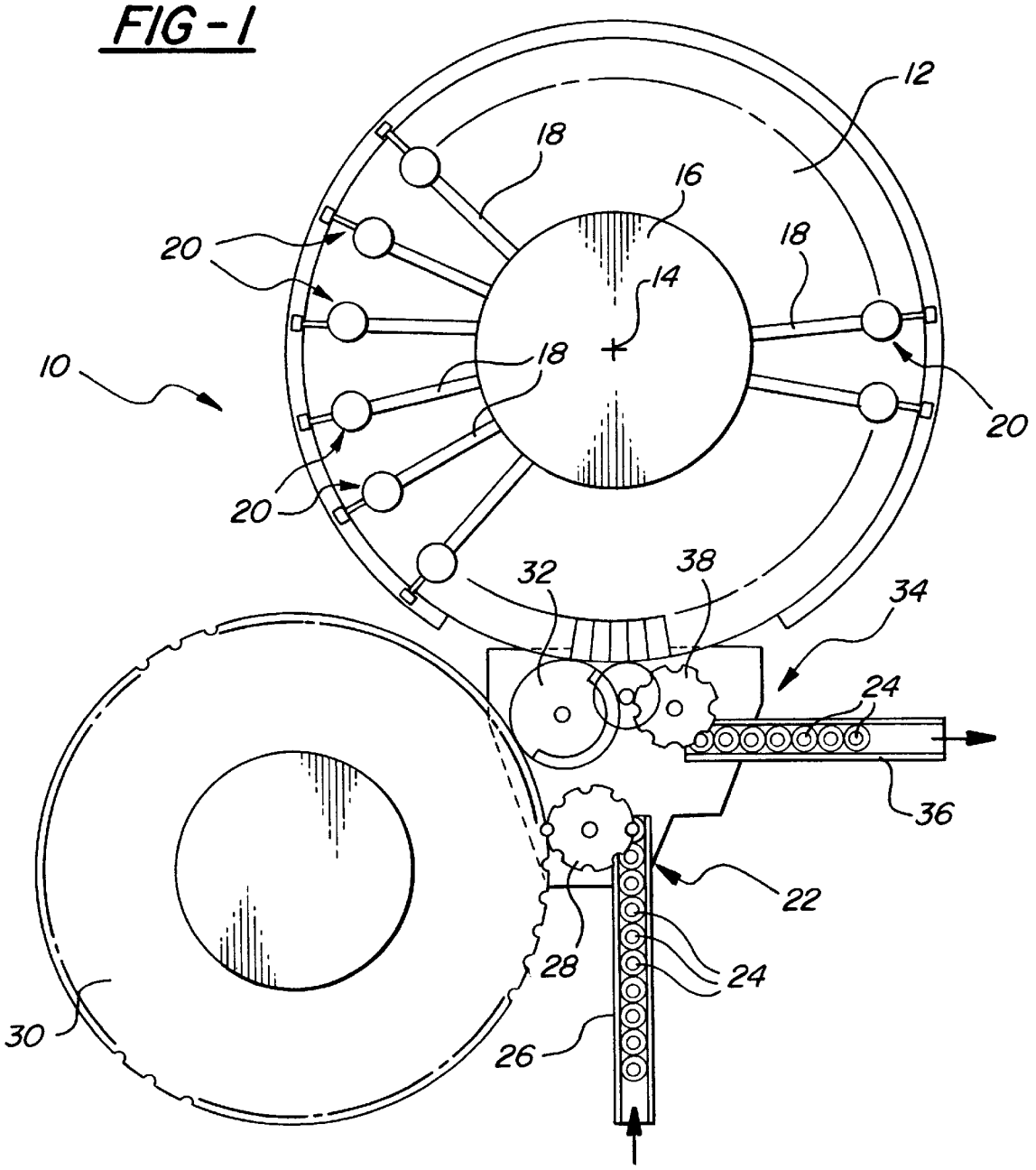
FIG. 1 is an overhead schematic view of a container filling apparatus incorporating the subject invention.

Referring to the Figures, wherein like numerals indicate like or corresponding parts throughout the several views, a container filling apparatus is generally shown at 10 in FIG. 1. The container filling apparatus 10 includes a carousel 12 for rotating about an axis 14. The carousel 12 includes a central product tank 16 and a plurality of product supply pipes 18. Each of the product supply pipes 18 extend radially from the product tank 16 to a corresponding filling machine assembly, generally shown at 20. The filling machine assemblies 20 will be discussed in greater detail hereinbelow.

An in-feed station, generally shown at 22, is disposed adjacent the carousel 12 for feeding empty containers 24 into the carousel 12. As will become apparent from the forgoing disclosure, the containers 24 may be any suitable type of container 24, such as cans, jars, or bottles, which are filled with any type of fluid material, such as beer or soft drinks, without deviating from the scope of the subject invention.

The in-feed station 22 includes a chute 26 and an in-feed wheel 28. The chute 26 guides the containers 24 from a supply source (not shown) into the in-feed wheel 28. The in-feed wheel 28 in turn supports and transfers the containers 24 into a precleaning station 30. The precleaning station 30 is mounted between the in-feed station and the carousel 12 for cleaning and rinsing the containers 24 before entering the carousel 12. The precleaning station 30 cleans, rinses and sterilizes the containers 24 with ionized air, ozone ($O_3$), hydrogen peroxide ($H_2O_2$), and/or water as is well known in the art.

The containers 24 are then transferred into a transfer station 32. The transfer station 32 is disposed between the precleaning station 30 and the carousel 12 for transferring the containers 24 from the precleaning station 30 to the carousel 12. Transfer stations 32 of this type are well known in the art.

An exit station, generally shown at 34, is disposed adjacent the carousel 12 for exiting filled containers 24 from the carousel 12. The exit station 34 also includes a chute 36 and an exit wheel 38 for transferring the filled containers 24 to a desired location. The exit wheel 38 transfers the containers 24 from the carousel 12 to the chute 36.

Figure 2:
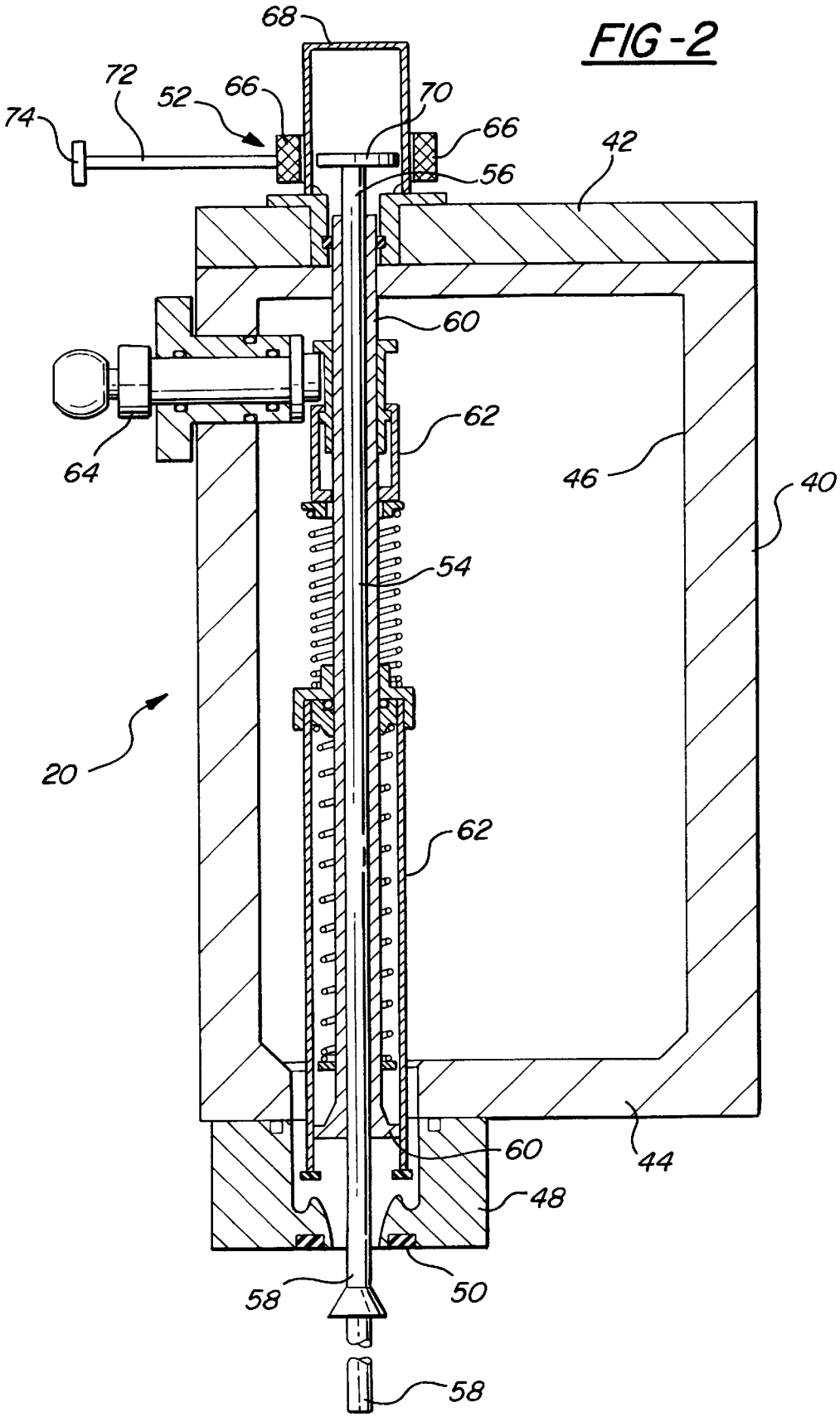
FIG. 2 is a partially cross-sectional view of a filling machine assembly shown in a filling position.
Figure 3:
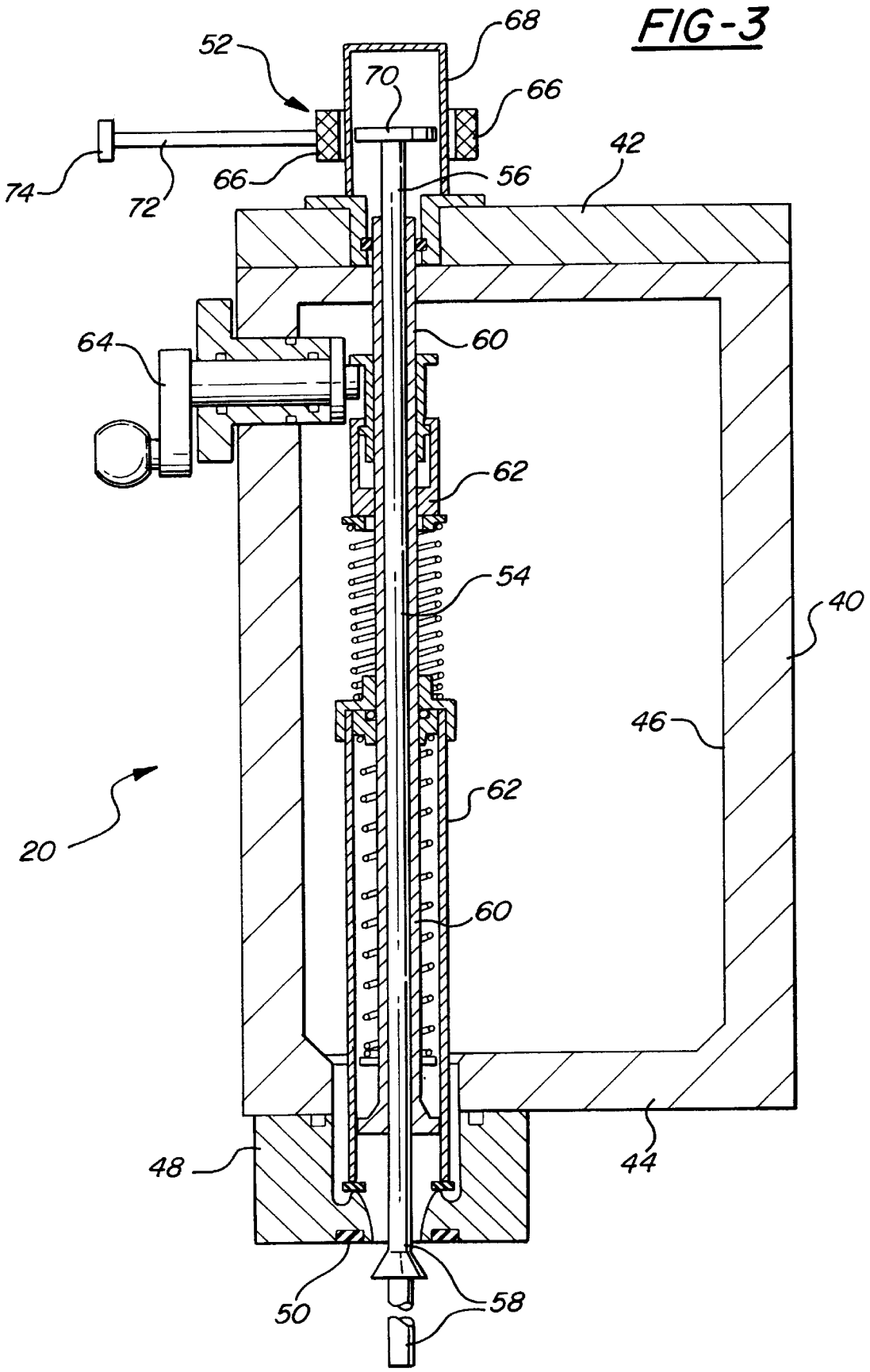
FIG. 3 is a partially cross-sectional view of the filling machine shown in a non-use position.

Referring also to FIGS. 2 and 3, a preferred embodiment of the filling machine assembly 20 is shown in greater detail. For illustrative purposes, only one filling machine assembly 20 is illustrated and it is understood that each of the machine assemblies on the carousel 12 are substantially similar. As appreciated by those skilled in the art, the number of filling machine assemblies 20 on the carousel 12 will be dependent upon the particular application as desired by the manufacturer. A typical carousel 12 may have as many as 120 filling machine assemblies 20 disposed thereon. Further, there may be additional precleaning stations and even post cleaning stations surrounding the carousel 12.

The filling machine assembly 20 comprises a support housing 40 having an upper surface 42 and a lower surface 44 defining an inner fluid chamber 46 for supplying the fluid material to be discharged into the corresponding container 24. As appreciated by those skilled in the art, the fluid material, which is preferably a liquid beverage, fills a portion of the fluid chamber 46 while leaving a space above the liquid for a pressurized inert gas such as carbon dioxide or nitrogen. The space above the liquid beverage is known in the art as the headspace. For illustrative purposes, the supply and return pipes for the liquid and gas as well as the liquid and gas themselves are not shown in these Figures.

A valve housing 48 is mounted to the lower surface 44 of the support housing 40 for controlling the discharge of the fluid material into the container 24. The valve housing 48 is shown schematically in the Figures and may be of any suitable design or configuration. An annular container seal 50 is provided within the valve housing 48 for sealingly engaging the container 24. In the embodiment shown in FIGS. 2 and 3, the container seal 50 is designed to seal against a bottle type container 24. As discussed below with reference to the alternative embodiments, the container seal 50 may be configured to accept a can. A control device, generally shown at 52, is disposed adjacent the upper surface 42 of the support housing 40. The control device 52 will be discussed in greater detail hereinbelow.

A vent tube 54 has a first end 56 and a second end 58 with the second end 58 at least partially extending through the valve housing 48. The vent tube 54 moves along a predetermined stroke between a filling position and a non-use position. In the embodiment illustrated in FIGS. 2 and 3, the second end 58 of the vent tube 54 is disposed within the container 24 while in the filling position and the second end 58 of the vent tube 54 is raised above the container 24 while in the non-use position. As appreciated, the vent tube 54 may also move in accordance with desired filling levels in different sized containers 24. The overall range for the stroke of the vent tube 54 may be adjusted and is dependent upon the type and size of container 24 being filled. As discussed in greater detail below, the vent tube 54 is in fluid communication with the headspace of the inner fluid chamber 46 in order to vent gases from the container 24 into the fluid chamber 46 during the filling of the container 24. Although not specifically shown, the vent tube 54 includes a number of apertures as is known in the art.

A support tube 60 is mounted between the upper surface 42 and the lower surface 44 of the support housing 40 and substantially surrounds the vent tube 54. Preferably, the support housing 40 encapsulates the central portion of the vent tube 54 while the first 56 and second 58 ends are not surrounded by the support tube 60. A plurality of seals (not shown) may be included between the vent tube 54 and the support tube 60 to support the vent tube 54 within the support housing 40.

A fluid sealing mechanism 62 is movably mounted with respect to the support tube 60 for controlling the discharge of the fluid material from the inner fluid chamber 46 to the container 24. An actuation lever 64 is mounted within the support housing 40 and engages the fluid sealing mechanism 62 for manipulating the mechanism 62 between an open position which discharges the fluid material through the valve housing 48 and a closed position which seals the fluid chamber 46 of the support housing 40 from the valve housing 48. As appreciated by those skilled in the art, the fluid sealing mechanism 62 and actuation lever 64 require a number of additional components to effectuate their operation. These additional components are well known in the art and are not discussed in any greater detail.

The general filling operation of the filling machine assembly 20 is now discussed. The fluid sealing mechanism 62 is initially closed and the vent tube 54 is raised as shown in FIG. 3. Atmospheric pressure prevails in the interior of the vent tube 54. An empty container 24 moves from the transfer station 32 and into position below one of the valve housings 48 of the carousel 12. The container 24 is then moved into sealing engagement with container seal 50 on the valve housing 48 and the vent tube 54 lowers into the filling position as shown in FIG. 2. The container 24 is purged with the inert gas from the inner fluid chamber 46 and through the vent tube 54 in order to flush air and other impurities from the container 24. The actuation lever 64 is actuated to lift the fluid sealing mechanism 62 to the open position. The liquid is then allowed to flow from the inner fluid chamber 46 and into the container 24 while the inert gas within the container 24 vents through the vent tube 54 into the headspace of the inner fluid chamber 46. The gas pressure in the container 24 and the inner fluid chamber 46 are equalized during the filling process which allows the liquid to flow into the container 24 solely under the influence of gravity. The container 24 continues to fill until the liquid rises to the level of the second end 58 of the vent tube 54. As known by those skilled in the art, the filling level within the container 24 is determined by the downward position of the second end 58 of the vent tube 54. Once the liquid material has reached to vent tube 54, the liquid can no longer flow into the container 24 because the gases can no longer escape through the vent tube 54. After the container 24 is filled to the desired level, the actuation lever 64 is actuated to move the fluid sealing mechanism 62 into sealing engagement with the valve housing 48, i.e., the closed position. The vent tube 54 then rises out of the container 24 to the non-use position as shown in FIG. 3. Finally, gas is released from the top of the container 24 to the atmosphere as is well known in the art.

The movement of the vent tube 54, which characterizes the subject invention, is now discussed in greater detail. The control device 52 includes at least one magnet 66 moveable between a first position and a second position for moving the vent tube 54 the predetermined stroke between the filling position and the non-use position. Preferably, there is an upper enclosure 68 which defines a working chamber (not numbered) for the first end 56 of the vent tube 54. The magnet 66 at least partially surrounds the upper enclosure 68. Even more preferably, the magnet 66 has a continuous donut like configuration. As illustrated, the first position of the magnet 66 is shown in FIG. 2 and the second position of the magnet 66 is shown in FIG. 3. The magnet 66 may have any suitable configuration and may extend only partially around the upper enclosure 68 without deviating from the overall scope of the subject invention.

A magnetic member 70 is mounted to the first end 56 of the vent tube 54 and is disposed within the working chamber. Preferably, the magnetic member 70 is a permanent disc shaped magnet. The magnetic field of the magnet 66 passes through the upper enclosure 68 and is attracted to the magnetic filed of the magnetic member 70. Hence, the vent tube 54 is controlled by the magnetic interaction through a closed wall 68. As appreciated by those skilled in the art, the magnet 66 and magnetic member 70 may have any suitable design or configuration and may be made of any suitable material. In fact, the magnetic member 70 may be replaced with a iron disc such that the magnet 66 is attracted to the iron. Also the magnets 66, 70 may be charged with an electrical current in order to enhance the magnetic field and attractive forces between the magnet 66 and magnetic member 70.

The control device 52 further includes an actuator 72, 74, connected to the magnet 66 to move the magnet 66 between the first and second positions. Preferably, the actuator 72, 74 includes a rod 72 and a cam roller 74. As appreciated, there are additional components which are not illustrated, such as a ramp, which operate with the actuator 72, 74 to move the magnet 66 between the first and second positions. In addition, the actuator 72, 74 may be of any suitable design or configuration so long as the magnet 66 can be moved between the first and second positions to move the vent tube 54 upwardly and downwardly. In fact, the rod 72 and cam roller 74 are simply illustrative of one proposed means for adjusting the magnet 66.

During operation of the vent tube 54, the cam roller 74 moves along a ramp or other like device which adjusts the upward and downward orientation of the actuator 72, 74 and magnet 66. As discussed above, the magnet 66 and magnetic member 70 are formed of particular materials which creates a strong magnetic bond between the magnet 66 and magnetic member 70. Hence, any upward or downward movement of the magnet 66, which may or may not be electrically charged, in turn moves the magnetic member 70 upward or downward. Also discussed above, the magnetic member 70 is affixed to the first end 56 of the vent tube 54 such that the vent tube 54 and magnetic member 70 move in unison. The upward and downward movement of the vent tube 54 can be easily and incrementally controlled by the actuation of the actuator 72, 74. The desired upward and downward movement of the vent tube 54 defines the predetermined stroke of the vent tube 54. The subject invention therefore creates a vent tube adjustment mechanism which avoids the use of a seal under pressure during the actuation of the vent tube 54. In other words, there are no differential pressures which act upon various rubber seals thereby reducing the likelihood of an operation failure or contamination. In addition there are fewer moving mechanical parts. Finally, the spaces, which can be created by rubber seals, for which bacteria can thrive, are significantly reduced.

Figure 4:
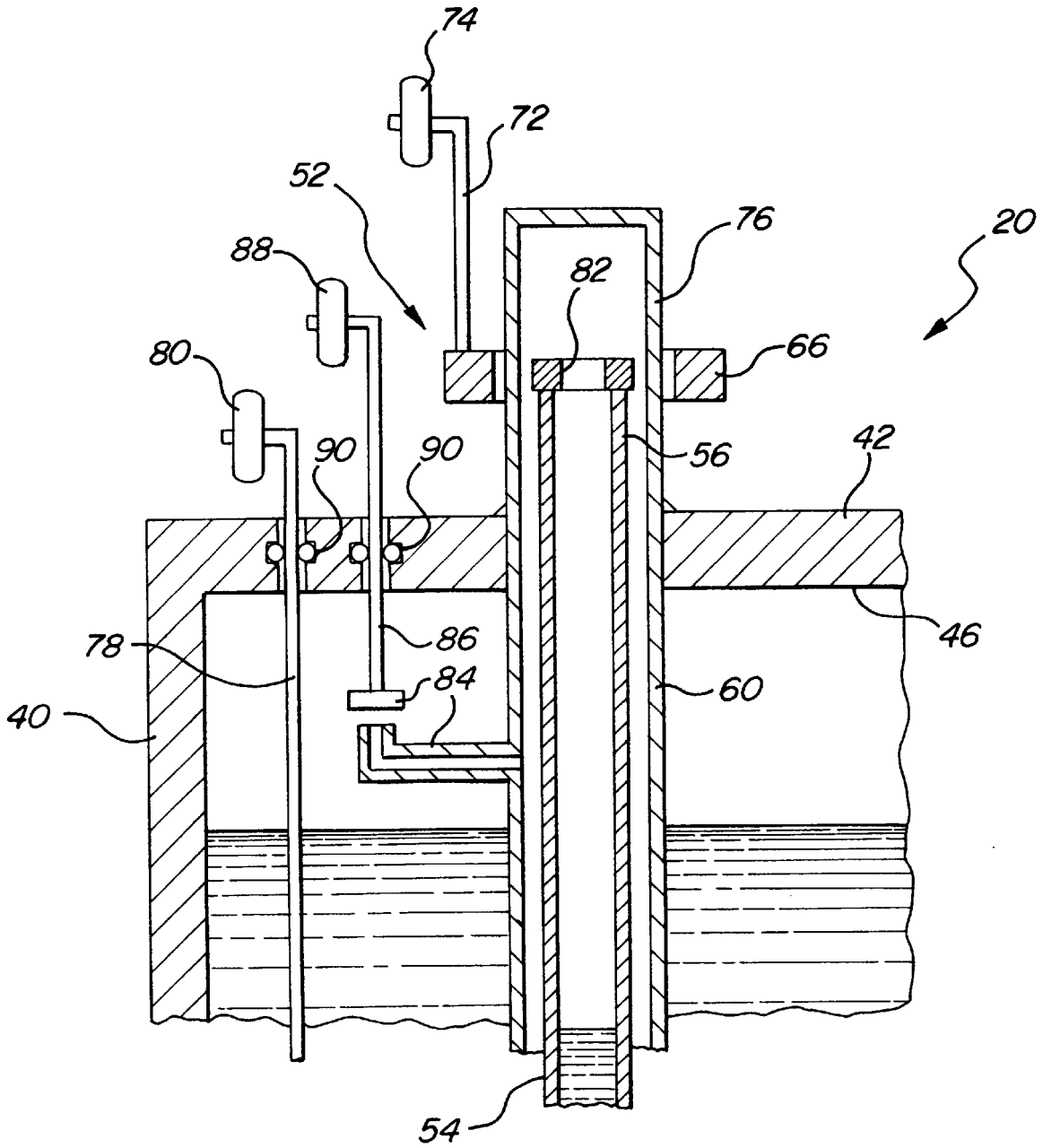
FIG. 4 is an alternative embodiment of the filling machine.
Figure 5:
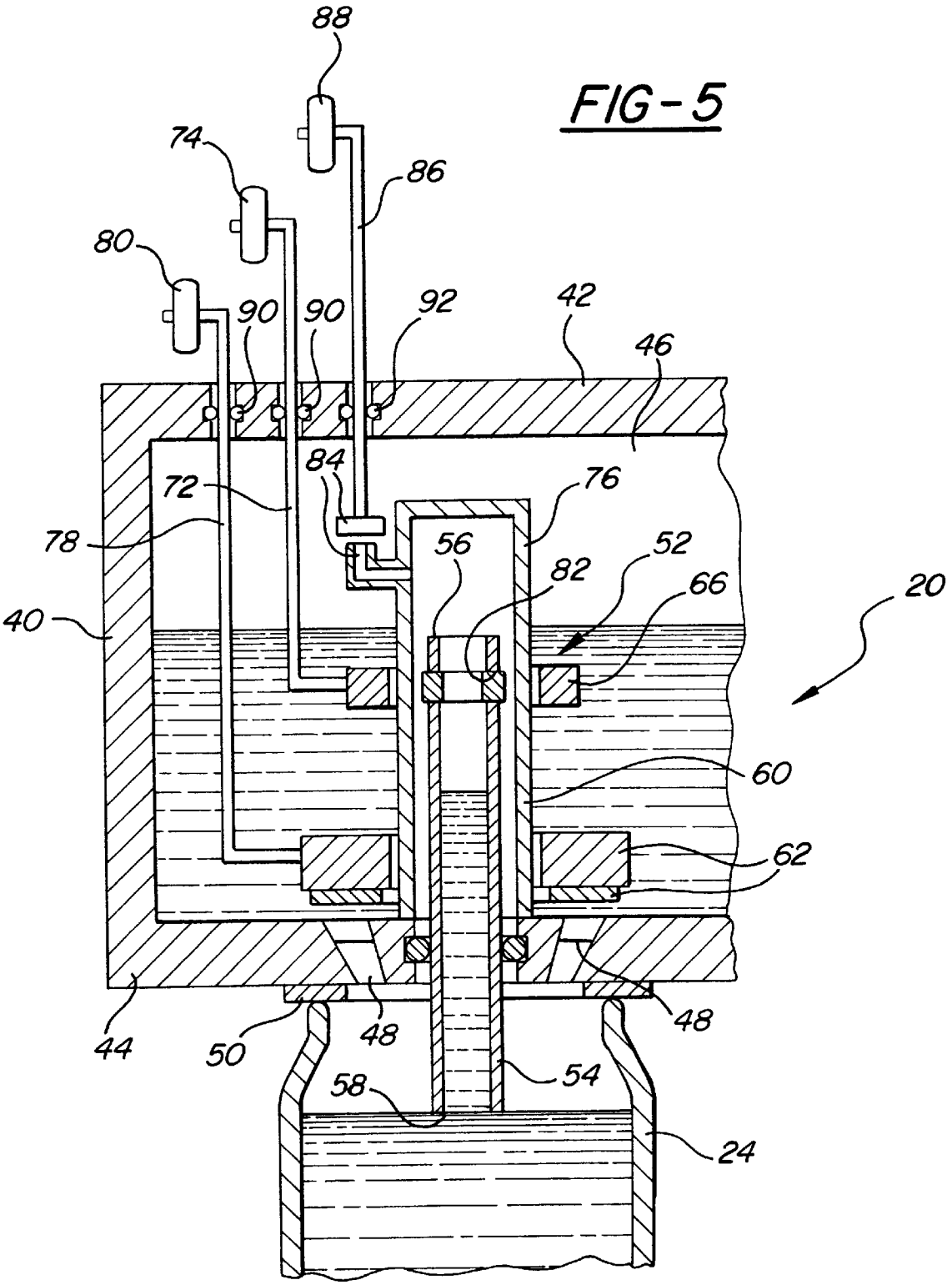
FIG. 5 is another alternative embodiment of the filling machine.

Referring to FIGS. 4 and 5, two alternative embodiment of the subject invention are shown. Like numerals indicating like or corresponding parts are used where possible. The filling machine assembly 20 according to these embodiments includes a support tube 60 substantially surrounding the vent tube 54 and having an upper portion 76 defining a working chamber (not numbered) for the first end 56 of the vent tube 54. Other components of these alternative embodiments, such as the support housing 40, valve housing 48, vent tube 54 and fluid sealing mechanism 62 are of slightly different configurations but operate is substantially the same manner. The fluid sealing mechanism 62 is operated by a rod 78 and cam roller 80 arrangement as opposed to an actuation lever. These embodiments are illustrative of another means by which the subject invention may be practiced. In addition, the fluid material and headspace are clearly illustrated in these Figures.

As in the preferred embodiment, a magnetic member 82 is mounted to the first end 56 of the vent tube 54 and disposed within the working chamber. The magnetic member 82, however, is a permanent magnet having a ring shaped configuration. The primary donut shaped magnet 66 at least partially surrounds the upper portion 76 of the support tube 60 which is similar in design to the donut shaped magnet 66 of the preferred embodiment. The control device 52 further includes a similar actuator 72, 74 connected to the magnet 66 to move the magnet 66 between the first and second positions. Preferably, the actuator 72, 74 includes a similar rod 72 and a cam roller 74. The support tubes 60 of these embodiments each include a release valve 84 for providing selective fluid communication between the vent tube 54 and the inner fluid chamber 46. The release valve 84 is also actuated by a corresponding rod 86 and cam roller 88. For illustrative purposes, the remaining portions of the release valve 84 are shown schematically. The rods 78, 86 of the fluid sealing mechanism 62 and release valve 84 each preferably extend out of the inner fluid chamber 46 through the upper surface 42 and are sealed from the chamber 46 by corresponding seals 90.

Referring in particular to FIG. 4, the support tube 60 is mounted between the upper surface 42 and the lower surface 44 of the support housing 40 with the upper portion 76 extending above the upper surface 42. This arrangement of the upper portion 76 of the support tube 60 corresponds to the upper enclosure 68 of the preferred embodiment.

Referring in particular to FIG. 5, the support tube 60 is completely disposed within the inner fluid chamber 46. Accordingly, the magnet 66 and actuator 72, 74 are also disposed within the inner fluid chamber 46. The upper surface 42 of the support housing 40 includes an opening (not numbered) having an associated seal 92 such that the rod 72 of the actuator 72, 74 may extend through the seal 92 in the opening. The rod 72 must exit the inner fluid chamber 46 in order to be actuated by the ramp or other like device. As appreciated, the rod 72 may exit out through a side of the inner fluid chamber 46 without deviating from the scope of the subject invention. A fluid sealing mechanism 62 is also illustrated in FIG. 5. As discussed above with reference to the preferred embodiment, the fluid sealing mechanism 62 is movably mounted with respect to the support tube 60 for controlling the discharge of the fluid material from the inner fluid chamber 46 to the container 24.

Figure 6:
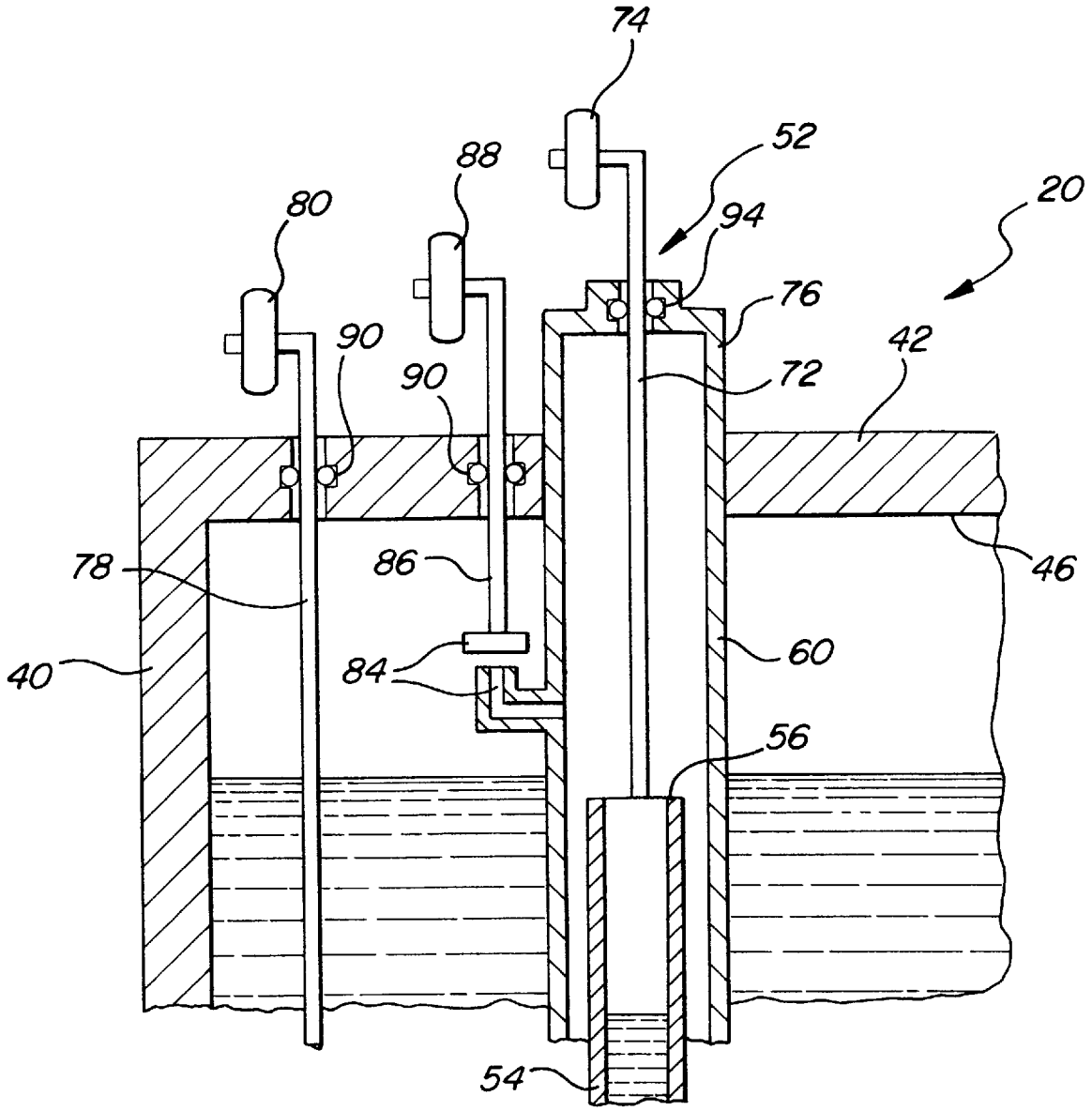
FIG. 6 is yet another alternative embodiment of the filling machine.

Referring to FIG. 6, yet another alternative embodiment of the subject invention is shown wherein like numerals indicating like or corresponding parts are used where possible. This embodiment eliminates the use of a magnet. The subject filling machine assembly 20 overcomes the prior art deficiencies by incorporating a support tube 60 mounted between the upper surface 42 and the lower surface 44 of the support housing 40 and substantially surrounding the vent tube 54 with the support tube 60 being characterized by an upper portion 76 extending above the upper surface 42 outside of the fluid chamber 46 wherein the control device 52 extends through the upper portion 76 of the support tube 60 outside of the fluid chamber 46 to move the vent tube 54 a predetermined stroke between a filling position and a non-use position. Accordingly, this embodiment of the subject invention also creates a vent tube adjustment mechanism which avoids the use of a seal under pressure during the actuation of the vent tube 54.

A seal 94 is disposed between the support tube 60 and the control device 52 for maintaining the vent tube 54 in a sealing relationship. The control device 52 is further defined as an actuator 72, 74 connected to the first end 56 of the vent tube 54 to move the vent tube 54 between the filling and non-use positions. Preferably, the actuator 72, 74 includes a rod 72 extending upwardly through the seal 94 in the upper portion 76 of the support tube 60. Similar to the prior embodiments, the support tube 60 includes a release valve 84 for providing selective fluid communication between the vent tube 54 and the inner fluid chamber 46.

The invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that within the scope of the appended claims, wherein reference numerals are merely for convenience and are not to be any way limiting, the invention may be practiced otherwise than as specifically described.

What is claimed is:

1. A filling machine assembly (20) for filling a container (24) with a fluid material, said assembly comprising:

a support housing (40) having an upper surface (42) and a lower surface (44) defining an inner fluid chamber (46) for supplying the fluid material to be discharged into the container (24);

a valve housing (48) mounted to said lower surface (44) of said support housing (40) for controlling the discharge of the fluid material;

a control device (52) disposed adjacent said upper surface (42) of said support housing (40); and a vent tube (54) having a first end (56) and a second end (58) with said second end (58) at least partially extending through said valve housing (48);

said assembly characterized by said control device (52) including at least one magnet (66) moveable between a first position and a second position for moving said vent tube (54) a predetermined stroke between a filling position and a non-use position.

2. An assembly as set forth in claim 1 further including an upper enclosure (68) defining a working chamber for said first end (56) of said vent tube (54).

3. An assembly as set forth in claim 2 further including a magnetic member (70) mounted to said first end (56) of said vent tube (54) and disposed within said working chamber.

4. An assembly as set forth in claim 3 wherein said magnetic member (70) is a permanent disc shaped magnet.

5. An assembly as set forth in claim 3 wherein said magnet (66) at least partially surrounds said upper enclosure (68).

6. An assembly as set forth in claim 5 wherein said magnet (66) has a donut like configuration.

7. An assembly as set forth in claim 5 wherein said control device (52) further ncludes an actuator (72, 74) connected to said magnet (66) to move said magnet (66) between aid first and second positions.

8. An assembly as set forth in claim 7 wherein said actuator (72, 74) includes a rod (72) and a cam roller (74).

9. An assembly as set forth in claim 1 further including a support tube (60) mounted between said upper surface (42) and said lower surface (44) of said support housing (40) and substantially surrounding said vent tube (54).

10. An assembly as set forth in claim 9 further including a fluid sealing mechanism (62) movably mounted with respect to said support tube (60) for controlling the discharge of the fluid material from said inner fluid chamber (46) to the container (24).

11. An assembly as set forth in claim 10 further including an actuation lever (64) mounted within said support housing (40) and engaging said fluid sealing mechanism (62) for manipulating said mechanism (62) between an open position which discharges the fluid material through said valve housing (48) and a closed position which seals said fluid chamber (46) of said support housing (40) from said valve housing (48).

12. An assembly as set forth in claim 1 further including a support tube (60) substantially surrounding said vent tube (54) and having an upper portion (76) defining a working chamber for said first end (56) of said vent tube (54).

13. An assembly as set forth in claim 12 further including a magnetic member (82) mounted to said first end (56) of said vent tube (54) and disposed within said working chamber.

14. An assembly as set forth in claim 13 wherein said magnetic member (82) is a permanent magnet having a ring shaped configuration.

15. An assembly as set forth in claim 13 wherein said magnet (66) at least partially surrounds said upper portion (76) of said support tube (60).

16. An assembly as set forth in claim 15 wherein said magnet (66) has a donut like configuration.

17. An assembly as set forth in claim 15 wherein said control device (52) further includes an actuator (72, 74) connected to said magnet (66) to move said magnet (66) between said first and second positions.

18. An assembly as set forth in claim 17 wherein said actuator (72, 74) includes a rod (72) and a cam roller (74).

19. An assembly as set forth in claim 18 wherein said upper surface (42) of said support housing (40) includes an opening having an associated seal with said rod (72) of said actuator (72, 74) extending through said seal in said opening.

20. An assembly as set forth in claim 17 wherein said support tube (60) includes a release valve (84) for providing selective fluid communication between said vent tube (54) and said inner fluid chamber (46).

21. An assembly as set forth in claim 20 wherein said support tube (60) is mounted between said upper surface (42) and said lower surface (44) of said support housing (40) with said upper portion (76) extending above said upper surface (42).

22. An assembly as set forth in claim 21 further including a fluid sealing mechanism (62) movably mounted with respect to said support tube (60) for controlling the discharge of the fluid material from said inner fluid chamber (46) to the container (24).

23. A filling machine assembly (20) for filling a container (24) with a fluid material, said assembly comprising:

a support housing (40) having an upper surface (42) and a lower surface (44) defining an inner fluid chamber (46) for supplying the fluid material to be discharged into the container (24);

a valve housing (48) mounted to said lower surface (44) of said support housing (40) for controlling the discharge of the fluid material;

a control device (52) disposed adjacent said upper surface (42) of said support housing (40);

a vent tube (54) having a first end (56) and a second end (58) with said second end (58) at least partially extending through said valve housing (20); and a support tube (60) mounted between said upper surface (42) and said lower surface (44) of said support housing (40) and substantially surrounding said vent tube (54);

said assembly characterized by said support tube (60) having an upper portion (76) extending above said upper surface (42) outside of said fluid chamber (46) wherein said control device (52) extends through said upper portion (76) of said support tube (60) outside of said fluid chamber (46) to move said vent tube (54) a predetermined stroke between a filling position and a non-use position.

24. An assembly as set forth in claim 23 further including a seal disposed between said support tube (60) and said control device (52) for maintaining said vent tube (54) in a sealing relationship.

25. An assembly as set forth in claim 24 wherein said control device (52) is further defined as an actuator (72, 74) connected to said first end (56) of said vent tube (54) to move said vent tube (54) between said filling and non-use positions.

26. An assembly as set forth in claim 25 wherein said actuator (72, 74) includes a rod (72) extending upwardly through said seal in said upper portion (76) of said support tube (60).

27. An assembly as set forth in claim 26 wherein said support tube (60) includes a release valve (84) for providing selective fluid communication between said vent tube (54) and said inner fluid chamber (46).

* * * * *